US005563697A

United States Patent [19]

Saito

[11] Patent Number: 5,563,697

[45] Date of Patent: Oct. 8, 1996

[54] SEPARATING APPARATUS FOR SEPARATING FOREIGN MATTER FROM A MAGNETIC TONER UTILIZING A VIBRATION GENERATOR AND A MAGNETIC FIELD GENERATOR

[75] Inventor: Hironobu Saito, Yokohama, Japan

[73] Assignee: Canon Kabushiki Kaisha, Tokyo, Japan

[21] Appl. No.: 363,007

[22] Filed: Dec. 23, 1994

[30] Foreign Application Priority Data

Dec. 27, 1993 [JP] Japan ..... 5-332687
Dec. 14, 1994 [JP] Japan ..... 6-310554

[51] Int. Cl.[6] ..... G03G 21/00
[52] U.S. Cl. ..... 355/298
[58] Field of Search ..... 355/296, 298; 118/652

[56] References Cited

U.S. PATENT DOCUMENTS

| | | | |
|---|---|---|---|
| 4,054,381 | 10/1977 | Bernhard | 355/298 X |
| 4,389,968 | 6/1983 | Satomura | 118/652 |
| 5,335,051 | 8/1994 | Tani | 355/245 |
| 5,455,666 | 10/1995 | Saito et al. | 355/298 |

FOREIGN PATENT DOCUMENTS

| | | |
|---|---|---|
| 0612002 | 7/1994 | European Pat. Off. . |
| 2-11913 | 3/1990 | Japan . |

OTHER PUBLICATIONS

Patent Abstracts of Japan, vol. 5, No. 81 (P–063) May 27, 1981.

Patent Abstracts of Japan, vol. 6, No. 212 (P–151) (1090) Oct. 26, 1982.

Patent Abstracts of Japan, vol. 6, No. 84 (P–117) (962) May 22, 1982.

*Primary Examiner*—William J. Royer
*Attorney, Agent, or Firm*—Fitzpatrick, Cella, Harper & Scinto

[57] ABSTRACT

A separating apparatus for separating foreign matter from a magnetic toner includes a filter having at least one opening for allowing passage of the magnetic toner, a vibration generator for vibrating the filter, a magnetic field generator for generating a magnetic field for attracting the magnetic toner and causing it to pass through the filter, and a stop for stopping the vibration generator when a predetermined time period has elapsed after the separating apparatus has been stopped.

41 Claims, 9 Drawing Sheets

SEPARATING APPARATUS FOR SEPARATING FOREIGN MATTER FROM A MAGNETIC TONER UTILIZING A VIBRATION GENERATOR AND A MAGNETIC FIELD GENERATOR

BACKGROUND OF THE INVENTION

1. Field of the Invention

The present invention relates to a separating apparatus for separating impurity from powder developer (referred to as "toner" hereinafter) An order to reuse the used toner for image formation used with an image forming apparatus such as an electrophotographic copying machine, art electrophotographic printer and the like for forming an image on a recording medium by using the toner, and an image forming apparatus utilizing such a separating apparatus.

2. Related Background Art

In conventional image forming apparatuses of this kind, it is common to collect toner removed from an electrophotographic photosensitive member by a cleaner after a toner image was formed on a recording medium. However, an image forming apparatus has been proposed wherein the collected toner is returned to a developing means for use in the image formation to achieve the effective use of the toner.

In addition, the toner collected in the cleaner includes various foreign matters such as paper powder generated from the recording medium, dust, aggregated toner particles and the lake mixed with the toner. If the collected toner is returned to the developing means as it is, it is impossible to obtain a good image.

To eliminate such a problem, regarding magnetic toner, it is considered to take advantage of the fact that the foreign matters mixed with the toner are substantially non-magnetic. That is to say, by generating a magnetic field in the vicinity of a mesh filter, the toner is forcibly passed through the filter, so that the foreign matters which were not passed through the filter are separated from the toner, which separated foreign matters are in turn collected (refer to, for example, Japanese Patent Publication No. 2-11913).

On the other hand, the inventors have proposed a technique in which magnetic field generating members are arranged above and below a mesh filter and the collected toner is supplied from a cleaner to a lower magnetic field so that, after the toner is absorbed to the lower magnetic field generating member, the toner alone is forcibly transferred to an upper stronger magnetic field through the mesh filter, thereby separating the foreign matters from the toner, which separated foreign matters are in turn collected (refer to U.S. Ser. Nos. 188,838, 188,883, 266,496 and 266,452).

According to the inventions described in the above U.S. Patent Application Specifications, when the magnetic toner is used as toner, the foreign matters can be removed from the magnetic toner effectively, and, even when the magnetic toner once used in the image formation is used again in other image formation, a good image can be obtained.

The present invention relates to a further improvement in the aforementioned inventions.

SUMMARY OF THE INVENTION

An object of the present invention is to provide a separating apparatus for re-generating magnetic toner which can be used in image formation, and an image forming apparatus utilizing such a separating apparatus.

Another object of the present invention is to provide a separating apparatus which can effectively remove foreign matters from magnetic toner and wherein, even when the magnetic toner once used in image formation is used again for other image formation, a good image can be obtained, and an image forming apparatus utilizing such a separating apparatus.

The other object of the present invention is to provide a separating apparatus and an image forming apparatus wherein foreign matters can be separated from the used toner in a stable and effective manner for a long time with less noise and less wear on parts.

The other object of the present invention is to provide a separating apparatus which can prevent clogging of the mesh filter and an image forming apparatus using it.

still another object of the present invention is to provide a separating apparatus in which a power source of a vibration applying means for applying vibration to the mesh filter is stopped after a predetermined time lapse after stoppage of driving. With such construction, unseparated collected developing agents, which have stayed in the separating portion after stoppage of the apparatus, will be separated by the mesh filter to which the vibration is applied. Thus, the developing agent will not stay on the mesh filter during stoppage of the apparatus, to thereby prevent clogging of the mesh filter by condensation or accumulation of the developing agent.

DETAILED DESCRIPTION OF THE PREFERRED EMBODIMENTS

Figure 1:
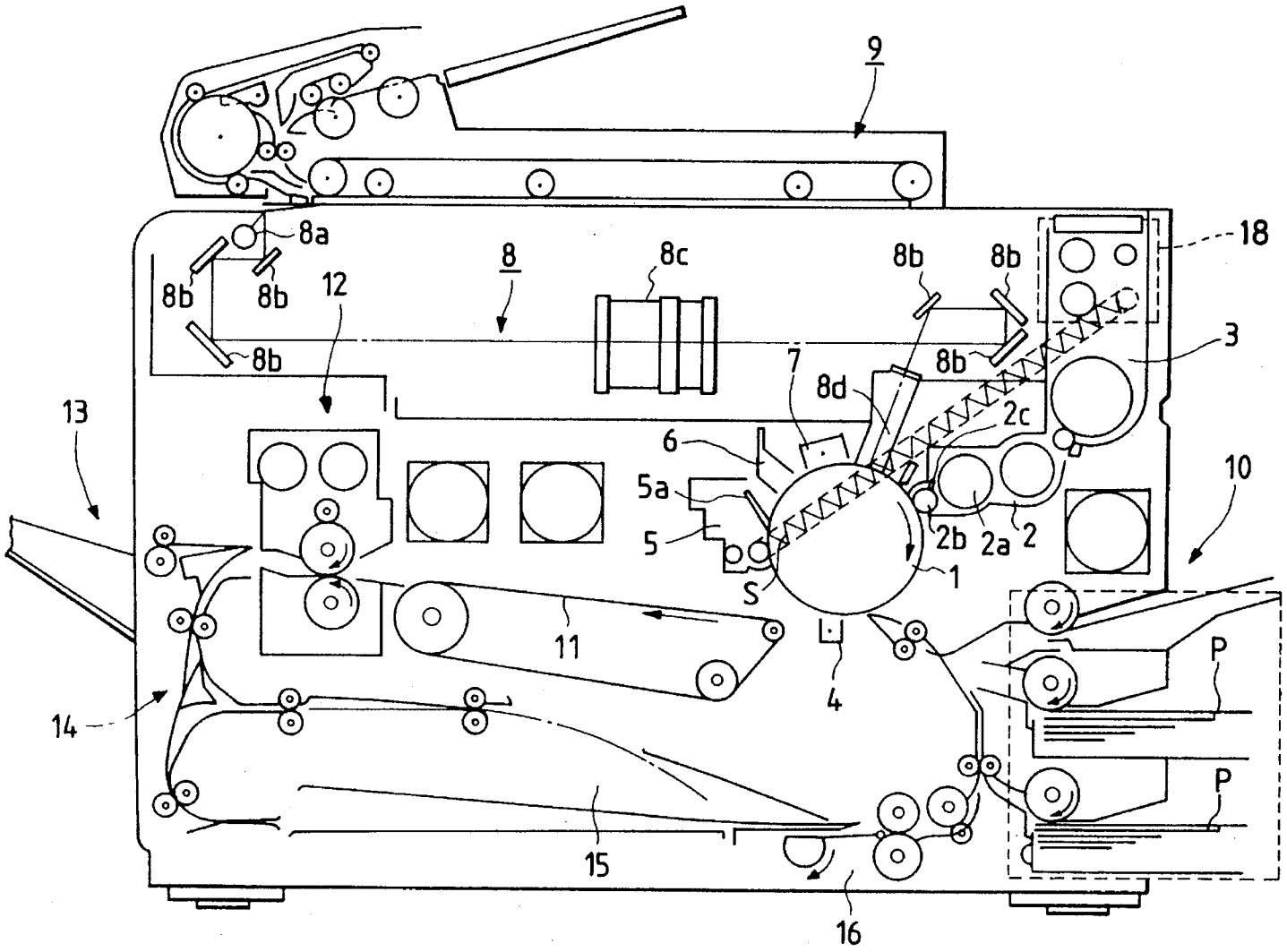
FIG. 1 is a constructural explaining view of an image forming apparatus having a separating apparatus of the present invention.

First of all, an embodiment of an image forming apparatus having a separating apparatus of the present invention will be explained with reference to the accompanying drawings. FIG. 1 is a schematic elevational sectional view of an electrophotographic copying machine as an image forming apparatus.

In FIG. 1, the image forming apparatus, i.e., a copying machine comprises an image bearing member (for example, a drum-like or belt-like electrophotographic photosensitive member) 1, a developing device 2 adapted to visualize a latent image formed on the image bearing member 1 (i.e., develop the latent image) with developer and having a hopper portion 3 for supplying the developer (one-component magnetic toner in the illustrated embodiment), a transfer means 4 for transferring a toner image visualized on the image bearing member 1 onto a sheet (recording medium), a cleaning device 5 for removing the residual toner and other foreign matters remaining on the image bearing member 1, an electricity removal means 6 for removing residual charge remaining on the image bearing member 1, a first charger 7 for uniformly charging the image bearing member 1, an optical reading system 8 for reading image information on an original, and an exposure portion 8*d* for exposing the image information on the image bearing member 1 to form the latent image. An original treating device 9 for directing the original to an image reading portion and a sheet supply portion 10 for supplying the sheet P to an image forming portion are associated with the image forming apparatus.

The image forming apparatus further comprises a convey means 11 for conveying the sheet P, a fixing device 12 for fixing the image (toner image) transferred to the sheet at the image forming portion to the sheet P, a sheet discharge portion 13 for discharging the sheet on which the image was formed, a re-supply sheet treatment portion 14 for directing the sheet to be re-supplied in a both-face recording mode or a multi-recording mode to the image forming portion again, an intermediate tray 15 for temporarily storing the sheets to be re-supplied, and a sheet re-supplying portion 16 for supplying the sheet stored on the intermediate tray 15 to the image forming portion again.

Next, an operation of the image forming apparatus will be explained. When a copy start button 76 (FIG. 6) is depressed, the original in the original treating device g is directed to the original reading portion, to radiate an image surface by a light source 8*a*, and to form the reflected light via a mirror 8*b* and an image-forming lens 8*c* as the light image. On the other hand, where the image information on the original is read by the optical reading system 8.

On the other hand, the image bearing member 1 from which electricity was previously removed by the electricity removal means 6 is charged to predetermined potential by the first charger 7, and then, at the exposure portion 8*d*, the image information is written on the image bearing member as a latent image. The latent image formed on the image bearing member 1 is visualized with magnetic toner by the developing device 2 as a toner image. When the magnetic toner in the developing device 2 is decreased, new magnetic toner is replenished to the developing device from the hopper portion 3. That is, the magnetic toner supplied from the hopper portion 3 is fed by the toner feed roller 2*a* to be adhered to a surface of a developing roller 2*b*. The, thickness of the tones layer is regulated by a developing blade 2*c*. A developing bias is applied between the developing roller 2*b* and the photosensitive drum %o develop the latent image formed on the drum. When the sheet P is sent to a transfer station of the image forming portion from the sheet supply portion 10, the toner image formed on the image bearing member 1 is transferred onto the sheet P by the transfer means 4. After the transferring operation, the sheet P is sent to the fixing device 12, where the toner image is fixed to the sheet P.

After the fixing operation, in a single-sided copy mode, the sheet P is discharged to the discharge portion 13. On the other hand, in a double-sided copy mode or a multi-copy mode,-the sheet is not discharged to the discharge portion, but is sent to the re-supply sheet treatment portion 14 by which the sheet is then stored on the intermediate tray 15. When a predetermined number of sheets are stacked on the intermediate tray, the sheets are separated one by one by means of the re-supplying portion 16, and the separated sheet is re-supplied to the transfer station of the image forming portion. When a next original is sent to the image reading portion by the original treating device 9, the above mentioned image forming operations are repeated, thereby forming the toner image on the other surface of the sheet. Then, the sheet is discharged to the discharge portion 13.

After the transferring operation, the toner (which was not transferred from the image bearing member 1 to the sheet P) and paper powder, dust and the like (referred to as "foreign matters" hereinafter) remaining on the image bearing member are removed by the cleaning device 5 (In the illustrated embodiment, the toner and the foreign matters remaining on the image bearing member 1 are removed by an elastic cleaning blade 5*a*.) The removed toner and foreign matters are sent, by a screw S, to a separating apparatus 18 which will be described later.

A separating apparatus 18 will be explained with FIGS. 2 to 5, 10 and 11.

Figure 2:
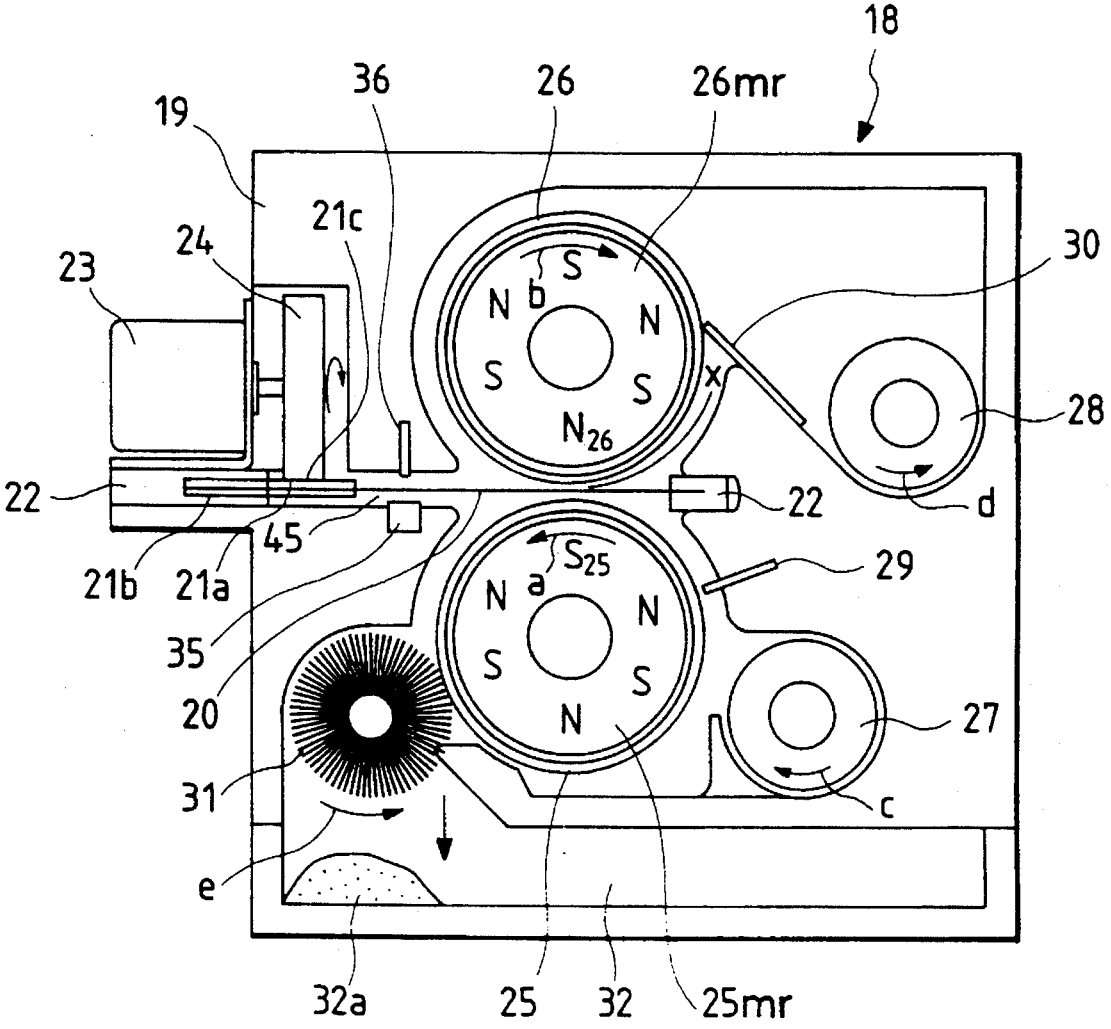
FIG. 2 is a constructural explaining view of a separating apparatus as an embodiment of the present invention.

The separating apparatus 18 has a frame within which a mesh filter 20 made of non-magnetic material (for example, non-magnetic stainless steel wires, non-magnetic brass wares, nylon fibers or the like) is arranged along a direction substantially perpendicular to a gravity acting direction (i.e., at an inclination angle of 0° with respect to a horizontal plane). Sleeves 25, 26 (for example, made of aluminum) incorporating respective magnet rollers 25mr, 26mr are disposed above and below the mesh filter Incidentally, as shown in FIG. 2, each magnet roller 25mr, 26mr has N poles and S poles alternately arranged. In a condition that magnetic poles $S_{25}$ and $N_{26}$ of the magnet rollers 25mr, 26mr are opposed to each other as shown in FIG. 1, the sleeves 25, 26 are rotated in directions shown by arrows a, b in FIG. 2. That is to say, the sleeves 25, 26 are rotated in opposite directions. By the rotation of the sleeve residual matter which has adhered to a surface of the sleeve 25, is shifted in the same direction as the rotational direction of the sleeve 25. On the other hand, by the rotation of the sleeve 26, the magnetic toner adhered to a surface of the sleeve 26 is shifted in the same direction as the rotational direction of the sleeve 26.

Incidentally, a relation between magnetic forces of the magnetic poles $S_{25}$, $N_{26}$ at a separating zone X where the sleeves 25, 26 are opposed to each other with the interposition of the mesh filter 20 by which the foreign matters are separated from the magnetic toner is $N_{26} > S_{25}$.

Further, convey screws 27, 28 for conveying the residual matter serves to convey the magnetic toner and the foreign matters collected in the cleaning device 5 to the separating apparatus 18, and a convey screw 28 for conveying the toner serves to convey the magnetic toner (from which the foreign matters were removed) to the hopper portion 3 of the developing device 2. A doctor blade 29 serves to regulate a thickness of a layer of the residual matter adhered to the sleeve 25, and a scraper blade 30 serves to scrape the magnetic toner adhered to the sleeve 26 and to guide the scraped toner to the convey screw 28.

Next, a separating operation of the separating apparatus 18 for separating the foreign matters from the magnetic toner will be explained. First of all, the mixture of the magnetic toner and the foreign matters removed from the image bearing member 1 by the cleaning device 5 is supplied to the proximity of the sleeve 25 in the separating apparatus 18 by means of the convey screw 27. Then, the mixture is adhered to the surface of the sleeve 25 to be conveyed upwardly by the rotation of the sleeve 25. That is to say, the mixture is sent to the separating zone X. Although the foreign matter such as paper powder is non-magnetic, since it is mixed with the magnetic toner when the residual matter is removed from the image bearing member, the foreign matter is adhered to the surface of the sleeve 25 together with the magnetic toner. A thickness of a layer of the mixture of the magnetic toner and the foreign matters adhered to the sleeve 18 are regulated by the doctor blade 29, and the mixture is sent to the separating zone X where the sleeves 25, 26 are opposed to each other.

As mentioned above, the relation between the magnetic poles $S_{25}$ and $N_{26}$ at the separating zone X is $N_{26} > S_{25}$. Thus, the mixture sent to the separating zone X by the sleeve 25 is flying from the surface of the sleeve 25 toward the surface of the sleeve 26 under the action of magnetic fields formed by the magnet rollers 25mr, 26mr. In this case, since there is the mesh filter 20 between the sleeves 25, 26, only the magnetic toner having a small particle diameter can pass through the mesh of the mesh filter 20, and the foreign matters such as paper powders each having a particle diameter remarkably greater than that of the magnetic toner cannot pass through the mesh filter 20.

Since the mesh of the mesh filter 20 (preferably, 150 μm (#100) to 37.5 μm (#400)) has an opening greater than the particle diameter of the magnetic toner (average particle diameter of 5 to 20 μm) by several times, the magnetic toner can smoothly pass through the mesh of the filter.

On the other hand, since the magnetic toner adhered to the foreign matter is flying toward the surface of the sleeve 26, an amount of the magnetic toner on the foreign matter is greatly decreased, resulting in a force for flying the foreign matter in opposition to the gravity force is greatly reduced, thereby dropping the foreign matter onto the surface of the sleeve 25 by its own weight.

Further, in the illustrated embodiment, even if the foreign matter is caught by the mesh of the filter 20, since vibration is applied to the filter 20 by vibration applying means to be explained later. The foreign matter caught by the filter 20 can be dropped by the vibration. Thus, the foreign matter will be removed from the magnetic toner. The magnetic toner which has been removed from the foreign matter is fed to the hopper 3 to be mixed with the non-used toner for reuse.

The separating apparatus 18 will be further described. In FIG. 2, the mesh filter 20 is pinched between flexible sheets 21 at its one end and is held together with the flexible sheets by the frame 19 of the separating apparatus 18 via a support member 22. A drive motor 23 to which an eccentric cam (vibration applying means) 24 for applying the vibration to the mesh filter 20 is connected the support member 22. The cam 24 connected to the drive motor 23 is contacted with one of the flexible sheets 21 so that the vibration is applied to the flexible sheets 21 by rotation of the eccentric cam 24 when the motor 23 is driven, with the result that the vibration is transmitted to the mesh filter 20 through the flexible sheets 21.

Figure 3:
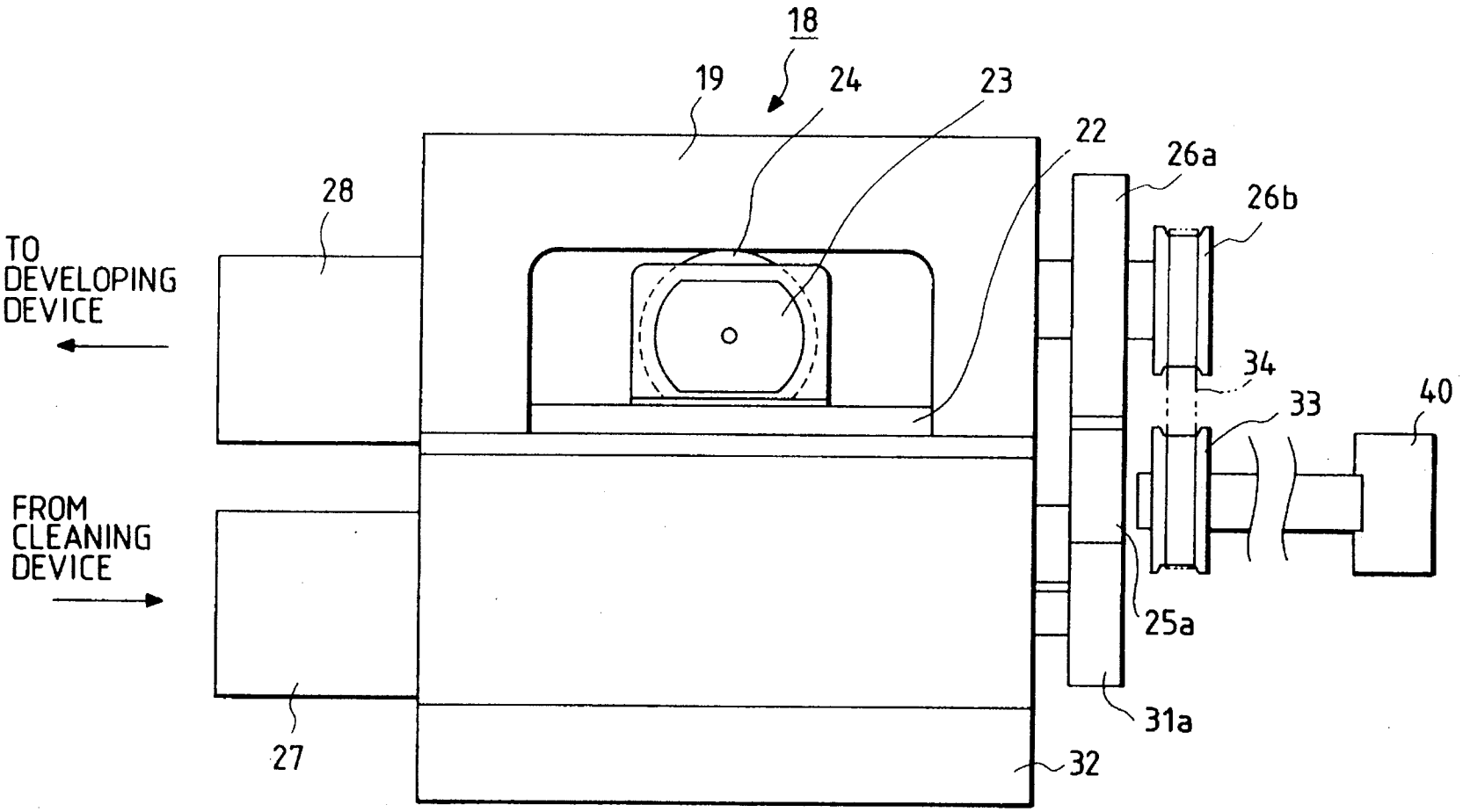
FIG. 3 is a side view of the separating apparatus.
Figure 4:
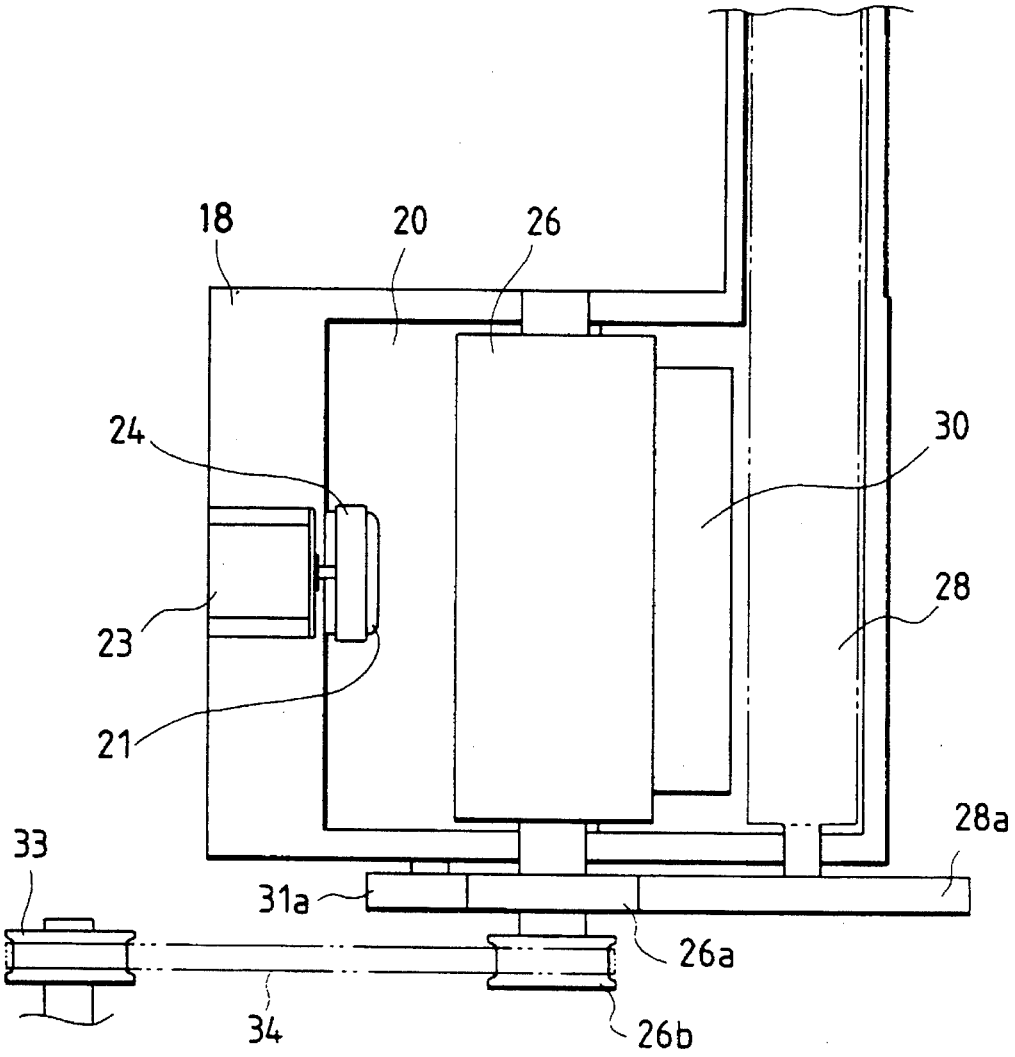
FIG. 4 is a schematic cross section of the separating apparatus.

Upper and lower sleeves 26, 25 incorporating magnets (magnetic force generating means) i.e. magnetic rollers 26mr, 25mr therein are arranged above and below the mesh filter 20, respectively. As shown In FIG. 3, the driving force from a drive source of the image forming apparatus is transmitted to drive gears 26mr, 25mr of the upper and lower sleeves 26, 25 via a drive belt 34 extending between a drive pulley 33 of the image forming apparatus and a drive pulley 26*b* of the separating apparatus. As a result, the sleeves 25, 26 are rotated in directions shown by the arrows a, b in FIG. 2, respectively. Incidentally, a relation between magnetic poles $N_{26}$ and $S_{25}$ at the separating zone X where the upper sleeve 26 is opposed to the lower sleeve 25 with the interposition of the mesh filter 20 is set to $N_{26} > S_{25}$.

A magnet 35 opposed to a magnetic plate 36 with the interposition of the mesh filter 20 is arranged in a communication passage 45 between the separating zone X and a vibration applying portion 21*a* (i.e., contact portion between the flexible sheet 21 and the eccentric cam 24 connected to the drive motor 23), thereby creating a concentrated magnetic field. With this arrangement, the floating toner particles are caught by the concentrated magnetic field, thereby preventing the toner from entering into the vibration applying portion 21*a*.

The driving force from a drive source 40 of the image forming apparatus is transmitted to convey screws 27, 28 (for conveying the toner) via a screw drive gear (not shown) meshed with the sleeve drive gear 25mr (FIG. 3) and a screw drive gear 28*a* (FIG. 4) meshed with the sleeve drive gear 26mr. Thus, the convey screws 27, 28 are rotated in directions shown by the arrows c, d in FIG. 2, respectively. The convey screw 27 serves to convey the toner (including foreign matters such as paper powder, dust and the like) collected by the cleaning device 5 to the separating apparatus 18, and the convey screw 28 serves to convey the toner from which the foreign matters were separated to the developing device 2 including the hopper portion 3. Further, a brush (foreign matter collecting means) 31 serves to scrape the foreign matter adhered to the surface of the lower sleeve 25 together with the residual toner into a collecting portion 32. As shown in FIG. 3, the driving force from the drive source 40 of the image forming apparatus is transmitted to the brush 31 through a drive gear 31*a* connected to the sleeve drive gear 25*a* via an idler gear (not shown) so that the brush 31 is rotated in a direction shown by the arrow e in FIG. 2 (same as the rotational direction of the lower sleeve 25) at a low speed.

Next, a separating operation of the separating apparatus 18 for treating the collected toner (including foreign matters such as paper powder, dust and the like) will be explained. As mentioned above, first of all, the toner collected from the photosensitive drum 1 by the cleaning device 5 is supplied to the lower sleeve 25 of the separating apparatus 18 by means of the convey screw 27. Incidentally, the collected toner includes the foreign matters such as paper powder, dust and the like. The collected toner is adhered to the lower sleeve 25 by the magnetic force, so that, as the sleeve 25 is rotated, the toner is conveyed upwardly. Meanwhile, a thickness of the toner layer adhered to the lower sleeve is regulated by the doctor blade 29 to a predetermined thickness. In this way, the collected toner is sent to the separating zone X where the sleeves 25, 26 are opposed to each other with the interposition of the mesh filter 20.

As mentioned above, the magnetic relation between the magnetic pole $N_{26}$ of the upper sleeve 26 and the magnetic pole $S_{25}$ of the lower sleeve 25 at the separating zone X is $N_{26} > S_{25}$. Thus, the collected toner (magnetic toner) sent to the separating zone X by the lower sleeve 25 is effectively attracted by the concentrated magnetic force extending from the magnetic pole $S_{25}$ of the lower sleeve 25 to the magnetic pole $N_{26}$ of the upper sleeve 26, with the result that only the magnetic toner is forcibly pulled upwardly toward the upper sleeve 26 through the mesh filter 20 in opposition to the gravity force, thereby adhering the toner to the upper sleeve 26. In this way, the magnetic toner is separated from the foreign matters.

Figure 5:
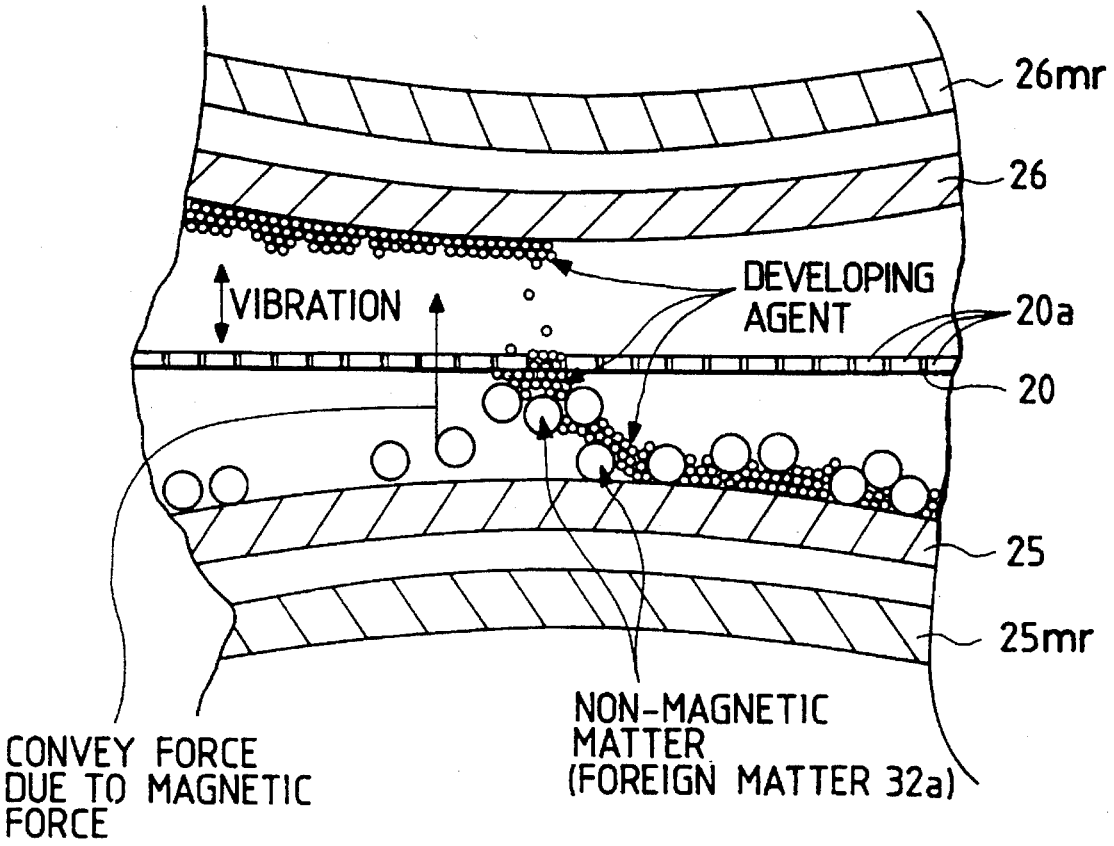
FIG. 5 is an enlarged explaining view showing separating state of collected developing agent at a separating portion of the separating apparatus.

As shown in FIG. 5, the mesh filter 20 has openings 20*a* each having a dimension greater than a diameter of the toner particle by several times (preferably, each opening has a size of 150 μm (#100) to 37.5 μm (#400)). Thus, in an initial clean condition, the toner can smoothly pass through the mesh filter. However, as the time goes on, since the aggregated toner lumps are accumulated in the openings of the mesh filter 20 not to pass through the filter (particularly, under a high humidity condition), thereby causing a so-called filter jam. However, in the illustrated embodiment, the filter 20 is vibrated (preferably, with frequency of 50 Hz or more and amplitude of about 0.2 to 4.0 mm) in a substantially vertical direction through the thin flexible sheets 21 (21*a*, 21*b*) (preferably, having a thickness of about 0.05 to 0.2 mm) by the eccentric cam 24 connected to the drive motor 23. Thus, the toner lumps caught by the filter 20 are decomposed by the vibration of the filter to eliminate the filter jam, so that the toner can easily be separated from the filter 20 (refer to FIGS. 10 and 11).

Further, as mentioned above, since the flexible sheets 21*a*, 21*b*, collectively depicted by reference numeral 39, pinching one end of the filter 20 near the vibration applying position are thin, they can be well restored from the flexure caused by the vibration. Thus, the flexible sheets 21 are finely vibrated to transmit the vibration to the filter 20, thereby effectively vibrating the mesh filter 20 without deforming the falter. Further, as mentioned above, since the flexible sheets 21*a*, 21*b* are thin layers having a thickness of about 0.05 to 0.2 mm, even when the flexible sheets are vibrated, vibration noise is very small, and, thus, the noise does not leak to the outside.

Further, at the separating zone X, although the toner is forcibly separated and conveyed by the magnetic force in opposition to the gravity force, the toner particles deviated from the magnetic field during the conveyance of the toner are floating in the frame of the separating apparatus. However, since the interior of the frame 19 within which the sleeves 25, 26 are disposed is completely enclosed, the floating toner can be prevented from leaking to the outside. Further, within the frame 19, since the separating zone X is spatially communicated with the vibration applying portion 21*c*, there is a danger of entering the floating toner into the vibration applying portion 21*c* through the communication passage 45. However, since the floating toner is caught by the concentrated magnetic field generated by the magnet 35 and the magnetic plate 36 opposed to each other with the interposition of the mesh filter 20 within the communication passage 45, the floating toner is prevented from reaching the vibration applying portion 21*c*. Further, as the separating time goes on, although an amount of the toner adhered to the magnet 35 and the magnetic plate 36 is gradually increased, since the toner consists of toner particles each having a diameter of about 10 μm, the connecting condition between the toner particles has versatility. Thus, even if the toner particles adhered to the magnet 35 or the magnetic plate 36 are contacted with the mesh filter 20, the vibration of the filter 20 is not damped, and, thus, the vibration generated by the drive motor 23 as the vibration applying means can effectively be transmitted to the mesh filter 20.

Further, in the illustrated embodiment, since it is so selected that the toner conveying force due to the magnetic force is sufficiently greater than the weight of the toner particle itself, the toner can easily be conveyed upwardly to be adhered to the upper sleeve 26.

Further, in the illustrated embodiment, it is so designed that the toner including the foreign matters is conveyed upwardly in opposition to the gravity force through the mesh filter 20 to separate the foreign matters from the magnetic toner. Thus, the separated foreign matters 32*a* such as paper powder, dust and the like are adhered to the undersurface of the mesh filter 20. However, since the mesh filter 20 is vibrated, the foreign matters are dropped from the filter by their own weights. Therefore, the foreign matters can effectively be separated from the toner, and the filter jam can be continuously prevented (FIG. 5).

Further, the toner (from which the foreign matters were separated) adhered to the upper sleeve 26 is conveyed downstream as the sleeve 26 is rotated, and is scraped from the surface of the sleeve 25 by the scraper blade 30, and the scraped toner is conveyed out of the separating apparatus 18 by the convey screw 28. Then, the toner is conveyed to the developing device 2 including the hopper portion 3 to be re-used in the development.

The foreign matters separated from the magnetic toner at the separating zone X, and dropped from the mesh filter are dropped onto the lower sleeve 25 and then are conveyed together with the residual toner (not flying toward the upper sleeve) as the lower sleeve is rotated. Then, the foreign matter is scraped from the lower sleeve 25 by the non-magnetic brush 31 arranged at a downstream side of the separating zone X in the toner conveying direction. Since the non-magnetic brush 31 is urged against the sleeve 25 with weak pressure, the foreign matters adhered to the sleeve 25 with a week force can be scraped from the sleeve. However, since the residual toner not separated at the separating zone X, is adhered to the sleeve 25 by the magnetic force, the residual toner is not scraped by the brush 31 but is further conveyed downstream for preparation for the next separation. Thus, the toner is almost not collected in the collecting portion 32, only the foreign matters 32*a* are collected in the collecting portion 32.

Now, an example of concrete values regarding the separating apparatus according to the aforementioned embodiment will be described. However, the present invention is not limited to such values.

First of all, the filter 20 is formed as a stainless steel mesh filter, and each opening thereof has a dimension of about 75 μm (#200). Further, a latitudinal length of the filter 20 is about 70 mm, a longitudinal length of the filter is about 40 mm, and a thickness of the filter is about 0.1 mm.

Further, the sleeves 25, 26 are made of aluminium and each has an outer diameter of about 20 mm. An outer diameter of each of the magnets 25*a*, 26*a* incorporated into the sleeves 25, 26 is 17.6 mm, and a distance between the sleeves 25 and 26 is about 3 mm. Furthermore, the $S_{25}$ pole has about 650 gauss and $N_{26}$ pole has about 1000 gauss. From the view point of developing ability and image quality, it is preferable that a weight average particle diameter ($D_4$) of the toner is 3 to 12 μm (preferably, 3 to 10 μm, and more preferably, 3 to 8 μm).

Although the grain size distribution of the toner can be measured by various methods, in the present invention, it was measured by using a Coaltar counter.

For example, a Coaltar counter TA-II (manufactured by Coaltar Co.) was used as a measuring device, end interfaces (manufactured by Nikkaki Co. in Japan) for outputting number distribution and volume distribution and a personal computer CX-1 (manufactured by Canon Co. in Japan) were connected to the measuring device. Aqueous solution including NaCl of 1% prepared by using first class sodium chloride was used as electrolyte. In the measurement, surface-active agent (preferably, alkyl benzene sulfonate) of 0.1 to 5 ml was added to the electrolytic solution of 100 to 150 ml as dispersing agent, and sample to be measured of 2 to 20 mg was also added to the electrolytic solution. The electrolytic solution including the sample suspension was subjected to the dispersing treatment for about 1 to 3 minutes by using a supersonic dispersing device. Thereafter, the volume of the toner and the number of toner particles were measured by the Coaltar counter TA-II using an aperture of 100 μm, thereby calculating the volume distribution and number distribution of toner particles of 2 to 40 μm. Thereafter, regarding the present invention, the weight average diameter (central value of each channel is used as a representative value of each channel) of weight reference sought from the volume distribution and standard deviation thereof, and a length average diameter of number reference sought from the number distribution and standard deviation thereof were determined.

Figure 6:
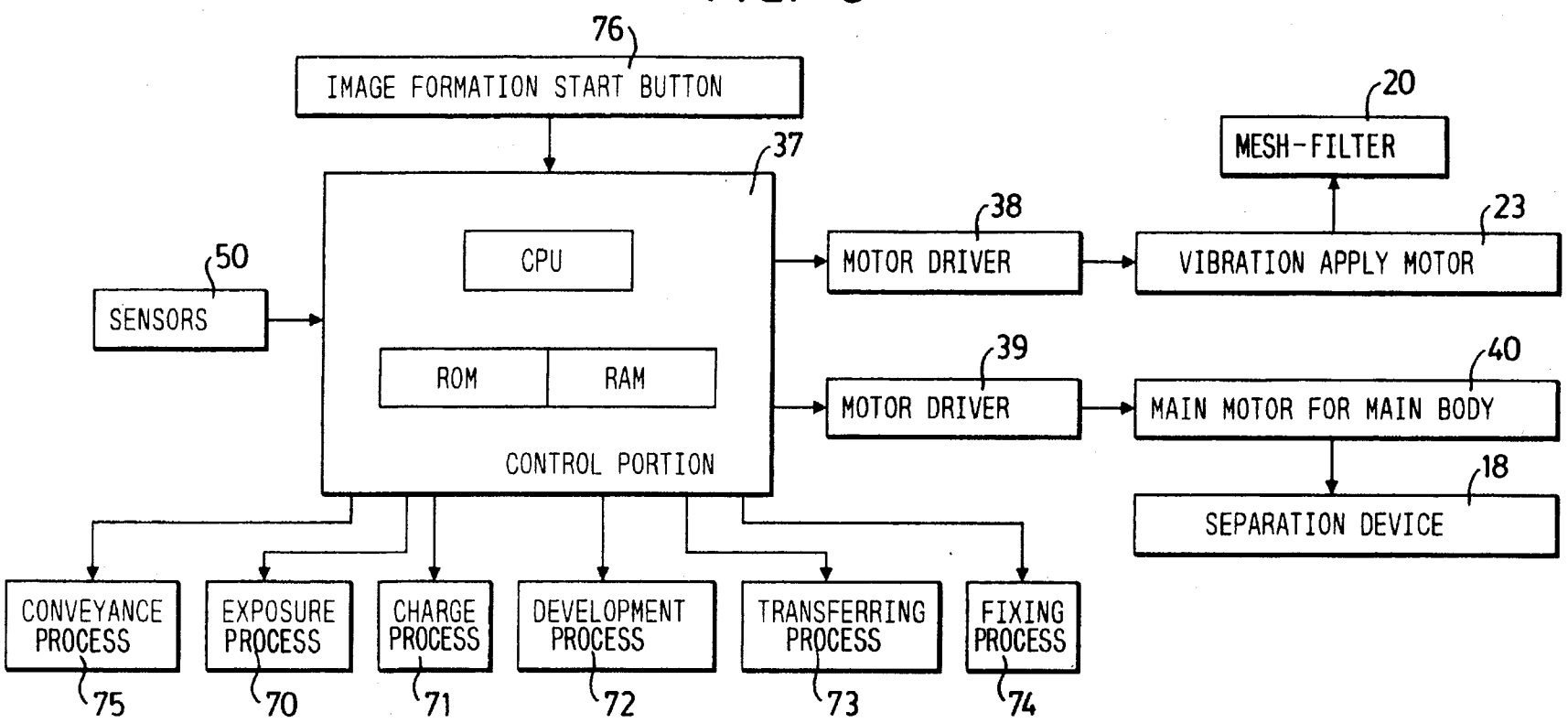
FIG. 6 is a block diagram of a control system.

Next, a control system for the image forming apparatus will be explained. In FIG. 6, a control portion 37 comprises a CPU, a ROM, a RAM and the like. The control portion 37 controls the drive motor (vibration applying means) 23 and the main motor 40 for driving the image forming apparatus via motor drivers 38, 39. The motors 23, 40 are controlled by the control portion 37 at timings shown in FIG. 7. Incidentally, in the illustrated embodiment, the mesh filter 20 alone is vibrated by the drive motor 23, and the other portions of the separating apparatus 18 and the entire image forming apparatus are driven by the main motor 40.

Figure 7:
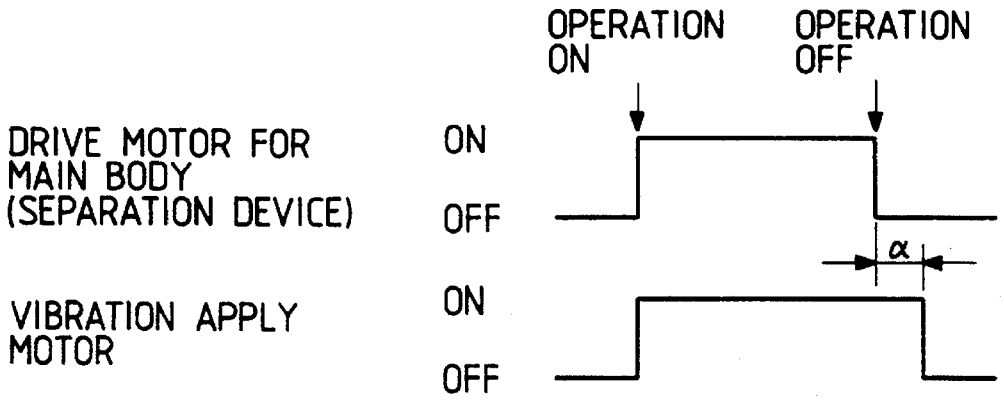
FIG. 7 is a timing chart showing a controlled stare of a drive source by the drive system.

As shown in FIG. 7, when an image formation start button 76 is depressed, the main motor 40 and the drive motor 23 are driven in synchronous with each other in response to a signal from the control portion 37. As a result, the above-mentioned image forming operation is performed. At the same time, the separating operation for separating the foreign matters from the magnetic toner is effected by the mesh filter 20 and the sleeves 25, 26. When the image formation is finished, the main motor 40 is stopped in response to a signal from the control portion 37. When a predetermined time period is elapsed after the main motor 40 was stopped, the drive motor 23 is stopped. The collected toner which has already been conveyed to the separating zone X when the main motor 40 is stopped is pulled upwardly by the magnetic field generated by the sleeves 25, 26 (now stopped) opposed to each other with the interposition of the mesh filter 20. However, in the illustrated embodiment, as mentioned above, the drive motor 23 is controlled so that it is stopped when the predetermined time period is elapsed after the main motor 40 was stopped. Thus, the mesh filter 20 is vibrated by the drive motor 23 driven within the above-mentioned predetermined time period, thereby separating the upwardly pulled toner or decomposing the aggregated toner lumps. Accordingly, the toner is not accumulated on the mesh filter 20, and, thus, the filter jam does not occur even when the separating apparatus is left as it is for a long time.

The control portion 37 will be further explained.

The control portion 37 serves to control the entire image forming apparatus and includes a CPU such as a microprocessor, a ROM for storing a control program and various data, and a RAM for temporarily storing various data and adapted to be used as a work area for the CPU. The control portion 37 receives signals from a group of sensors 50 including a sheet jam detection sensor (jam sensor). Further, the control portion 37 can control various processes such as an exposure process 70 (optical reading system 8), charge process 71 (charge means 7), development process 72 (developing device 2), transferring process 73 (transfer means 4) and fixing process 74 (fixing device 12), conveyance system 75 (sheet supply portion 10, sheet re-supply portion 16), and the separating device 18. In the illustrated embodiment, the image forming operation means an operation that the photosensitive drum 1 is being rotated. That is to say, the pre-rotation of the photosensitive drum 1 is normally effected by the main motor 40. Then, while the photosensitive drum 1 is being rotated, the photosensitive drum is subjected to the above-mentioned charge process, exposure process, development process, transferring process and cleaning process successively. Thereafter, the post-rotation of the photosensitive drum 1 is normally effected, and then, the drum is stopped. Thus, in the illustrated embodiment, the image forming operation means the above continuous rotation of the photosensitive drum 1. Incidentally, the pre-rotation and The post-rotation are often omitted. In any case, in the illustrated embodiment, the separating apparatus 18 (and accordingly, the sleeves 25, 26) except for the mesh filter 20 is driven and stopped in synchronous with the rotation of the photosensitive drum 1. Incidentally, the convey screws 27, 28 are driven by the main motor 40 in synchronous with the sleeves 25, 26. However, although the driving of the mesh filter 20 of the separating apparatus 18 is started by the drive motor 23 simultaneously with the driving of the photosensitive drum 1 and the separating apparatus 18, the mesh filter 20 is stopped when the predetermined time period is elapsed after the photosensitive drum 1 and the separating apparatus 18 were stopped (for example, in the illustrated embodiment, the predetermined time period α shown in FIG. 7 is five seconds, and preferably, three seconds). In the illustrated embodiment, as mentioned above, the separating apparatus 18, mesh filter 20, photosensitive drum 1 and the like are controlled by the program stored in the ROM of the control portion 37.

Incidentally, in the aforementioned embodiment, while an example that the driving of the separating apparatus 18 is effected in synchronous with the driving of the photosensitive drum i was explained, the present invention is not limited to this example, but may be applied to any separating apparatus and the image forming apparatus so long as the filter is stopped when the predetermined time period is elapsed after the separating apparatus was stopped.

Figure 8:
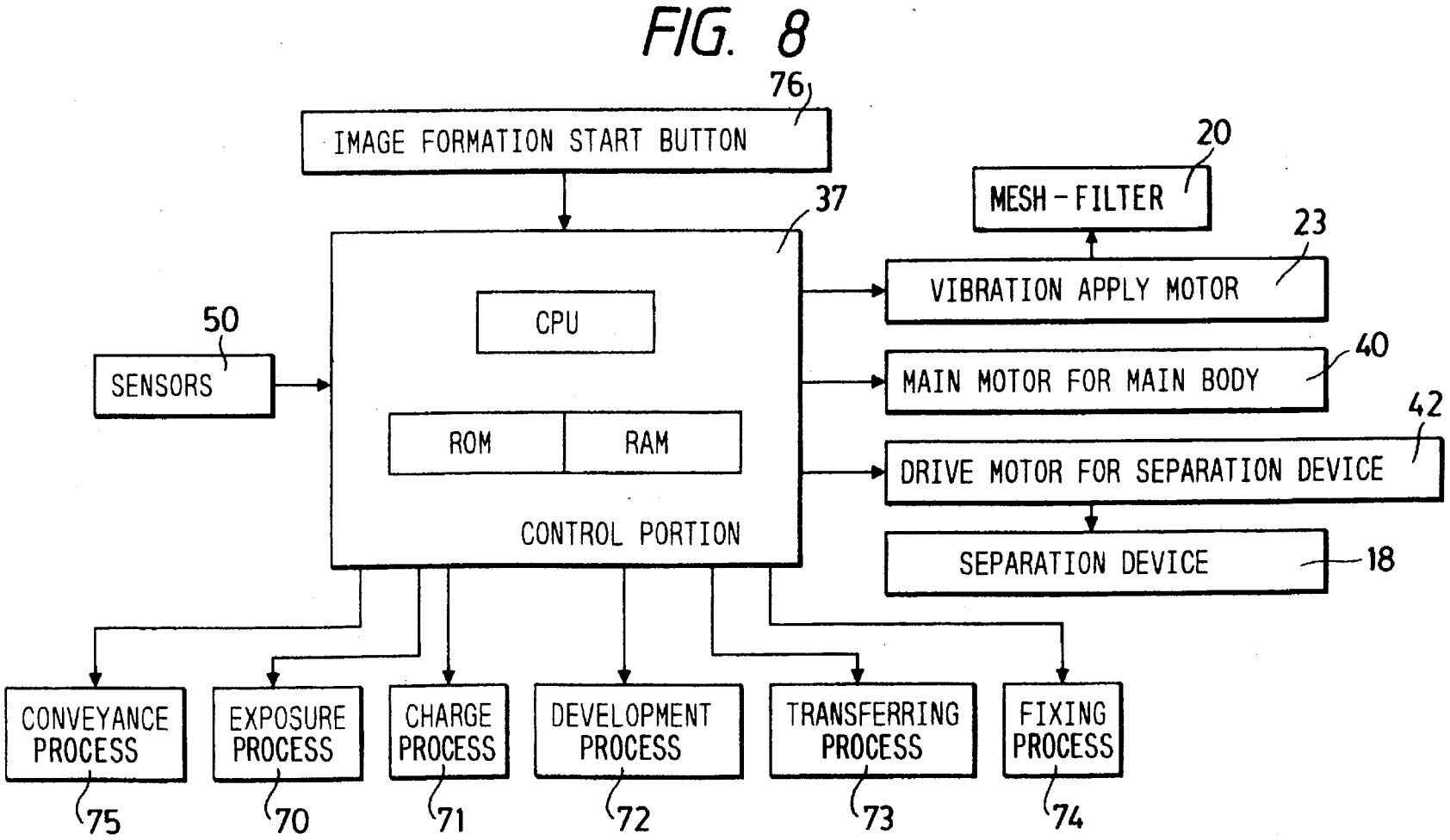
FIG. 8 is a block diagram of the control system.
Figure 10:
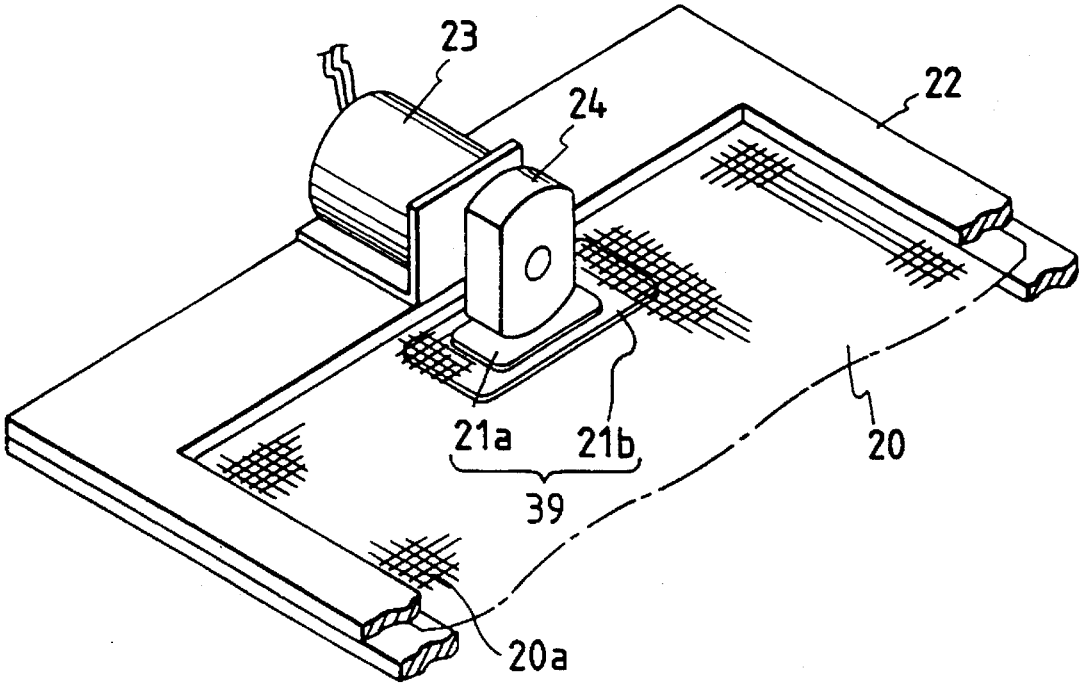
FIG. 10 is a perspective view of a separating apparatus to which the present invention is applied.
Figure 11:
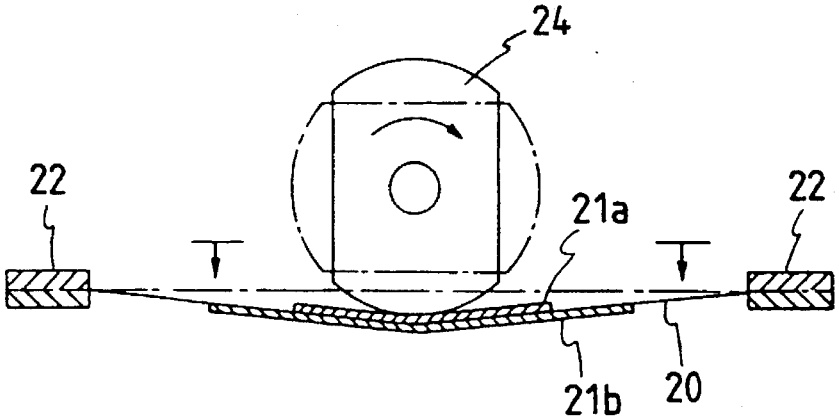
FIG. 11 is a side cross section of the separating apparatus to which the present invention is applied.

Further, in the aforementioned embodiment, while an example that the driving of the separating apparatus other than the mesh filter 20 is driven by the driving force transmitted from the main motor 40 of the image forming apparatus was explained, the present invention is not limited to this example, but, as shown in FIG. 8, a drive motor 23 for applying the vibration to the mesh filter 20, a main motor 40 of the image forming apparatus, and a drive motor 42 for driving the separating apparatus other than the mesh filter 20 may be provided independently, and these motors 23, 40 and 42 may be controlled by the control portion 37 via respective motor drivers (not shown). Such a control is effected by the program stored in the ROM of the control portion 37.

Figure 9:
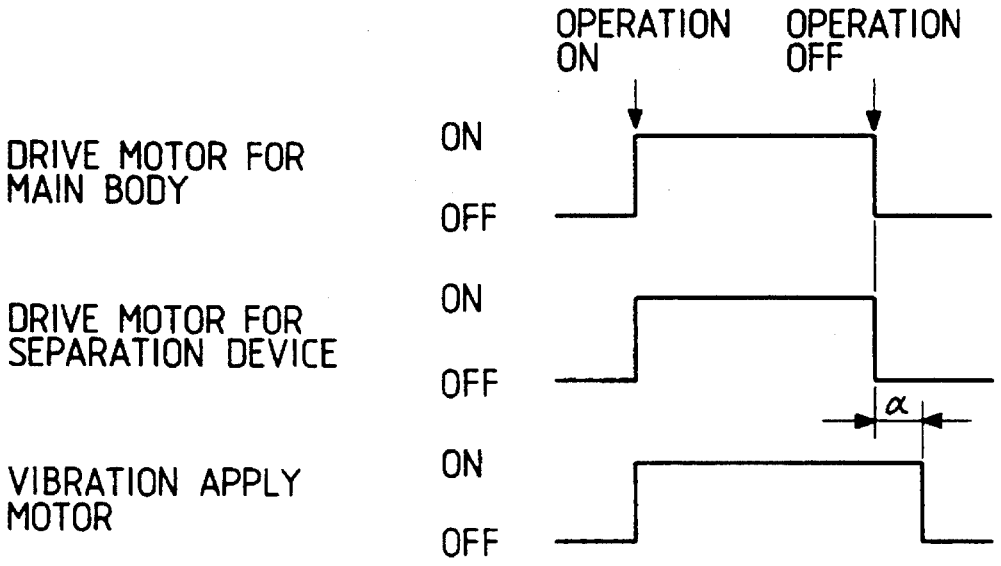
FIG. 9 is a timing chart showing a controlled state of a drive source by the control system.

In this case, when the image formation start button 76 is depressed, as shown in FIG. 9, the main motor 40 and the drive motors 23, 42 start to be driven in synchronous with each other in response to a signal from the control portion 37. When the image formation is finished, although the main motor 40 and the drive motor 42 are stopped in response to a signal from the control portion 37. Then, the drive motor 23 is stopped when 8 predetermined time period (for example, about 1 to 5 seconds) is elapsed alter the motors 40 42 were stopped. Thus, similar to the aforementioned embodiment, the toner is not accumulated on the mesh filter 20, and, thus, the filter jam does not occur even when the separating apparatus is left as it is for a long time.

Incidentally, in FIGS. 6 and 8, while an example that the control portion 37 directly controls the exposure process 70, charge process 71, development process 72, transferring process 73, fixing process 74 and conveyance process 75 was illustrated, as mentioned above, it should be noted that these processes are performed by the main motor 40.

Further, in the aforementioned embodiments, while an example that the magnetic toner collected after the transferring operation is the toner including the foreign matters and the foreign matters are separated from the collected magnetic toner was explained, the present invention is not limited to such an example, but may be applied to any cases wherein non-magnetic foreign matters are separated from magnetic toner.

Further, in the aforementioned embodiments, while an example that the present invention is applied to the image forming apparatus for forming the mono-color image was explained, the present invention is not limited to such an example, but may be applied to color image forming apparatuses wherein a plurality of developing devices containing different color toners are provided and a plural color image (for example, two-color image, three-color image or full-color image) is formed.

Furthermore, in the aforementioned embodiments, while an example that the photosensitive drum end the process means (charge means, developing device, cleaning device) are directly attached to the image forming apparatus was explained, the present invention is not limited to such an example, but may be applied to color image forming apparatuses wherein the photosensitive drum and the process means are formed as a unit which can removably mounted on the image forming apparatus.

Further, in the aforementioned embodiments, while the electrophotographic copying machine was explained as the image forming apparatus, the present invention is not limited to such a copying machine, but may be applied to other image forming apparatus such as a laser beam printer, a facsimile system or a word processor.

According to the aforementioned embodiments, it is designed so that the drive source for the vibration applying means for applying the vibration to the mesh filter is stopped when the predetermined tame period is elapsed after the separating apparatus was stopped. With this arrangement, since the collected toner remaining in the separating zone after the separating apparatus was stopped can be separated by the mesh filter which is still being vibrated, the toner is not accumulated on the mesh filter 20, and, thus, the filter jam due to the aggregation of the toner can be prevented.

As mentioned above, according to the present invention, the filter jam can surely be prevented, thereby always separating the foreign matters from the toner effectively.

What is claimed is:

1. A separating apparatus for separating a foreign matter from a magnetic toner, comprising:

a filter having at least one opening for allowing passage of the magnetic toner;

a vibration generating means for vibrating said filter;

a magnetic field generating means for generating a magnetic field for attracting the magnetic toner and causing it to pass through said filter; and a stop means for stopping said vibration generating means when a predetermined time period is elapsed after said separating apparatus was stopped.

2. A separating apparatus according to claim 1, wherein said vibration generating means vibrates said filter along a direction substantially perpendicular to a surface of said filter via rotation of an eccentric cam.

3. A separating apparatus according to claim 1, wherein the magnetic toner is magnetic toner removed from an electrophotographic photosensitive member, the magnetic toner being adhered to a peripheral surface of a first sleeve incorporating a first magnet therein to be conveyed to a position where said sleeve is opposed to said filter, and then, being attracted toward and adhered to a peripheral surface of a second sleeve arranged above said filter and incorporating therein a second magnet acting as said magnetic field generating means and capable of generating a magnetic force greater than that of said first magnet.

4. A separating apparatus according to claim 3, wherein said first and second sleeves are driven by a first motor while said vibration generating means is driven by a second motor, said second motor being stopped when the predetermined time period is elapsed after said first motor was stopped.

5. A separating apparatus according to claim 1 or 4, wherein said predetermined time period is about one to five seconds.

6. A separating apparatus according to claim 5, wherein said predetermined time period is preferably about three seconds.

7. A separating apparatus according to claim 3, wherein said first and second sleeves are rotated in opposite directions.

8. A separating apparatus according to claim 1, wherein said vibration generating means vibrates said filter along the direction substantially perpendicular to the surface of said filter, with an amplitude range of about 0.2 to 4.0 mm.

9. A separating apparatus according to claim 1, wherein said opening of said filter has a dimension of about 37.5 to 150.0 μm.

10. A separating apparatus according to claim 1, wherein said magnetic toner is one-component magnetic toner having a particle diameter of about 3.0 to 12.0 μm.

11. A separating apparatus according to claim 1, wherein said filter is made of stainless steel.

12. An image forming apparatus for an image on a recording medium, comprising:

an image bearing member;

an image forming means for forming a toner image on said image bearing member;

a transfer means for transferring the toner image formed on said image bearing member by said image forming means onto the recording medium;

a cleaning means for removing residual matter remaining on said image bearing member therefrom, after the toner image was transferred by said transfer means;

a separating means for removing a foreign matter from magnetic toner removed from said image bearing member by said cleaning means, said separating means including a filter having at least one opening through which the magnetic toner can pass, a vibration generating means for vibrating said filter, a magnetic field generating means for generating a magnetic field for attracting the magnetic toner and for causing it to pass through said filter, and a stop means for stopping said vibration generating means when a predetermined time period is elapsed after the separating apparatus was stopped; and a convey means for conveying the recording medium.

13. An image forming apparatus according to claim 12, wherein said vibration generating means vibrates said filter along a direction substantially perpendicular to a surface of said filter via rotation of an eccentric cam.

14. An image forming apparatus according to claim 12, wherein the magnetic toner is magnetic toner removed from an electrophotographic photosensitive member, the magnetic toner being adhered to a peripheral surface of a first sleeve incorporating a first magnet therein to be conveyed to a position where said sleeve is opposed to said filter, and then, being attracted toward and adhered to a peripheral surface of a second sleeve arranged above said filter and incorporating therein a second magnet acting as said magnetic field generating means and capable of generating a magnetic force greater than that of said first magnet.

15. An image forming apparatus according to claim 14, wherein said first and second sleeves are driven by a first motor and said vibration generating means is driven by a second motor, said second motor being stopped when the predetermined time period is elapsed after said first motor was stopped.

16. An image forming apparatus according to claim 12 or 15, wherein said predetermined time period is about one to five seconds.

17. An image forming apparatus according to claim 16, wherein said predetermined time period is preferably about three seconds.

18. An image forming apparatus according claim 14, wherein said first and second sleeves are rotated in opposite directions.

19. An image forming apparatus according to claim 12, wherein said vibration generating means vibrates said filter along the direction substantially perpendicular to the surface of said filter, with an amplitude range of about 0.2 to 4.0 mm.

20. An image forming apparatus according to claim 12, wherein said opening of said filter has a dimension of about 37.5 to 150.0 μm.

21. An image forming apparatus according to claim 12, wherein said magnetic toner is one-component magnetic toner having a particle diameter of about 3.0 to 12.0 μm.

22. An image forming apparatus according claim 12, wherein said filter is made of stainless steel.

23. A separating apparatus for separating a foreign matter from magnetic toner, comprising:

a filter having at least one opening through which the magnetic toner can pass;

a vibration generating means for vibrating said filter;

a first sleeve incorporating a first magnet therein and adapted to convey the magnetic toner to a position where said first sleeve is opposed to said filter;

a second sleeve arranged in an opposed relation to said first sleeve with the interposition of said filter and adapted to attract the magnetic toner adhered to a peripheral surface of said first sleeve through said filter, said second sleeve incorporating therein a second magnet for generating a magnetic force greater than that of said first magnet; and a stop means for stopping said vibration generating means when a predetermined time period is elapsed after the first and second sleeves were stopped.

24. A separating apparatus according to claim 23, further comprising a first motor for driving said first and second sleeves, and a second motor for driving said vibration generating means.

25. A separating apparatus according to claim 24, wherein said vibration generating means vibrates said filter along a direction substantially perpendicular to a surface of said filter via rotation of an eccentric cam.

26. A separating apparatus according to claim 23, wherein said predetermined time period is about one to five seconds.

27. A separating apparatus according to claim 26, wherein said predetermined time period is preferably about three seconds.

28. A separating apparatus according to claim 23 or 26, wherein said first and second sleeves are rotated in opposite directions.

29. A separating apparatus according to claim 23, wherein said vibration generating means vibrates said filter along the direction substantially perpendicular to the surface of said filter, with an amplitude range of about 0.2 to 4.0 mm.

30. A separating apparatus according to claim 23, wherein said opening of said filter has a dimension of about 37.5 to 150.0 μm.

31. A separating apparatus according to claim 23, wherein said magnetic toner is one-component magnetic toner having a particle diameter of about 3.0 to 12.0 μm.

32. A separating apparatus according to claim 23, wherein said filter is made of stainless steel.

33. An image forming apparatus for forming an image on a recording medium, comprising:

an image bearing member;

an image forming means for forming a toner image on said image bearing member;

a transfer means for transferring the toner image formed on said image bearing member by said image forming means onto the recording medium;

a cleaning means for removing residual matter remaining on said image bearing member from the latter, after the toner image was transferred by said transfer means;

a separating means for removing a foreign matter from magnetic toner removed from said image bearing member by said cleaning means, said separating means including a filter having at least one opening through which the magnetic toner can pass, a vibration generating means for vibrating said filter, a first sleeve incorporating a first magnet therein and adapted to convey the magnetic toner to a position where said first sleeve is opposed to said filter, a second sleeve arranged in an opposed relation to said first sleeve with the interposition of said filter and adapted to attract the magnetic toner adhered to a peripheral surface of said first sleeve through said filter and incorporating therein a second magnet for generating e magnetic force greater than that of said first magnet, and a stop means for stopping said vibration generating means when a predetermined time period is elapsed after the first and second sleeves were stopped; and a convey means for conveying the recording medium.

34. An image forming apparatus according to claim 33, further comprising a first motor for driving said first and second sleeves, and a second motor for driving said vibration generating means.

35. An image forming apparatus according to claim 33, wherein said vibration generating means vibrates said filter along a direction substantially perpendicular to a surface of said filter via rotation of an eccentric cam.

36. An image forming apparatus according to claim 33, wherein said predetermined time period is about one to five seconds.

37. An image forming apparatus according to claim 36, wherein said predetermined time period is preferably about three seconds.

38. An image forming apparatus according to claim 33 or 36, wherein said first and second sleeves are rotated in opposite directions.

39. An image forming apparatus according to claim 33, wherein said vibration generating means vibrates said filter along the direction substantially perpendicular to the surface of said filter, with an amplitude range of about 0.2 to 4.0 mm.

40. An image forming apparatus according to claim 33, wherein said opening of said filter has a dimension of about 37.5 to 150.0 μm.

41. An image forming apparatus according to claim 33, wherein said magnetic toner is one-component magnetic toner having a particle diameter of about 3.0 to 12.0 μm.

* * * * *

UNITED STATES PATENT AND TRADEMARK OFFICE

CERTIFICATE OF CORRECTION

PATENT NO. : 5,563,697

DATED : October 8, 1996

INVENTOR(S) : Hironobu SAITO

It is certified that error appears in the above-identified patent and that said Letters Patent is hereby corrected as shown below:

COLUMN 1:

Line 12, "An" should read --in--; and
Line 30, "lake" should read --like--.

COLUMN 2:

Line 16, "still" should read --Still--;
Line 40, " showing" should read --showing a--; and
Line 44, " stare" should read --state--.

COLUMN 3:

Line 32, "device g" should read --device 9--;
Line 50, "The," should read --The--;
Line 51, "tones" should read --toner--;
Line 53, "%o" should read --to--; and
Line 65, "-the" should read --the--.

UNITED STATES PATENT AND TRADEMARK OFFICE

CERTIFICATE OF CORRECTION

PATENT NO. : 5,563,697

DATED : October 8, 1996

INVENTOR(S) : Hironobu SAITO

It is certified that error appears in the above-indentified patent and that said Letters Patent is hereby corrected as shown below:

COLUMN 4:

Line 14, "device 5" should read --device 5.--; and
Line 30, "filter" should read --filter 20.--.

COLUMN 5:

Line 33, "is" should read --being--; and
Line 50, "connected" should read --connected to--.

COLUMN 8:

Line 56, "end" should read --and--.

COLUMN 9:

Line 27, "synchronous" should read --synchronism--.

UNITED STATES PATENT AND TRADEMARK OFFICE

CERTIFICATE OF CORRECTION

PATENT NO. : 5,563,697

DATED : October 8, 1996

INVENTOR(S) : Hironobu SAITO

It is certified that error appears in the above-indentified patent and that said Letters Patent is hereby corrected as shown below:

COLUMN 10:

Line 15, "synchronous" should read --synchronism--;
Line 18, "synchronous" should read --synchronism--;
Line 33, "synchronous" should read --synchronism--;
and
Line 34, "drum i" should read --drum 1--;
Line 54, "synchronous" should read --synchronism--;

COLUMN 11:

Line 23, "end" should read --and--; and
Line 41, "tame" should read --time--.

UNITED STATES PATENT AND TRADEMARK OFFICE

CERTIFICATE OF CORRECTION

PATENT NO. : 5,563,697

DATED : October 8, 1996

INVENTOR(S) : Hironobu SAITO

It is certified that error appears in the above-indentified patent and that said Letters Patent is hereby corrected as shown below:

COLUMN 12:

Lien 36, "for" should read --for forming--.

Signed and Sealed this

Eighteenth Day of March, 1997

Bruce Lehman

*Attest:*

BRUCE LEHMAN

*Attesting Officer*

*Commissioner of Patents and Trademarks*